US011395933B2

(12) United States Patent
Rosenfeldt

(10) Patent No.: US 11,395,933 B2
(45) Date of Patent: Jul. 26, 2022

(54) FIRE FIGHTING DEVICE

(71) Applicant: Viking Life-Saving Equipment A/S, Esbjerg (DK)

(72) Inventor: Jesper Rosenfeldt, Læsø (DK)

(73) Assignee: Viking Life-Saving Equipment A/S, Esbjerg (DK)

( * ) Notice: Subject to any disclaimer, the term of this patent is extended or adjusted under 35 U.S.C. 154(b) by 182 days.

(21) Appl. No.: 16/461,473

(22) PCT Filed: Nov. 16, 2017

(86) PCT No.: PCT/DK2017/050378
§ 371 (c)(1),
(2) Date: May 16, 2019

(87) PCT Pub. No.: WO2018/091055
PCT Pub. Date: May 24, 2018

(65) Prior Publication Data

US 2019/0344108 A1 Nov. 14, 2019

(30) Foreign Application Priority Data

Nov. 16, 2016 (EP) ..... 16199101
Sep. 20, 2017 (EP) ..... 17192104

(51) Int. Cl.
*A62C 31/22* (2006.01)
*A62C 31/24* (2006.01)

(52) U.S. Cl.
CPC ..... *A62C 31/22* (2013.01); *A62C 31/24* (2013.01)

(58) Field of Classification Search
CPC ..... A62C 31/24; A62C 31/22; B05B 3/06
See application file for complete search history.

(56) References Cited

U.S. PATENT DOCUMENTS 2,251,175 A * 7/1941 Tappe ..... A62C 31/24 408/56
2,813,753 A * 11/1957 Roberts ..... B05B 1/14 239/DIG. 13

(Continued)

FOREIGN PATENT DOCUMENTS

CN 101678223 A 3/2010
CN 202724526 U 2/2013

(Continued)

OTHER PUBLICATIONS

Chinese Search Report dated Jul. 17, 2020, 11 pages.

(Continued)

*Primary Examiner* — Joseph A Greenlund
(74) *Attorney, Agent, or Firm* — Berg Hill Greenleaf Ruscitti LLP

(57) ABSTRACT

A fire fighting device comprises a fire fighting aggregate (3) for penetrating a wall (5) and injecting fire fighting fluid into a space behind the wall. The fire fighting aggregate (3) comprises: a fluid driven rotating motor, such as a turbine, with a rotor (303) carrying a rotating cutting element (305), and a fluid inlet (109) for receiving fire fighting fluid to drive the rotor (303); a support (1) for attachment to the wall (5) suspending the fire fighting aggregate (3), at least the rotating cutting element (305) being movable relative to the support (1) towards the wall (5); a power means (322, 340) for pressing the rotating cutting element (305) towards the wall (5); and a second conduit for feeding the fire fighting fluid to the power means (322, 340) to provide for said power means (322, 340) to press the rotating cutting element (305) towards the wall (5).

23 Claims, 12 Drawing Sheets

(56) References Cited

Figure 1:
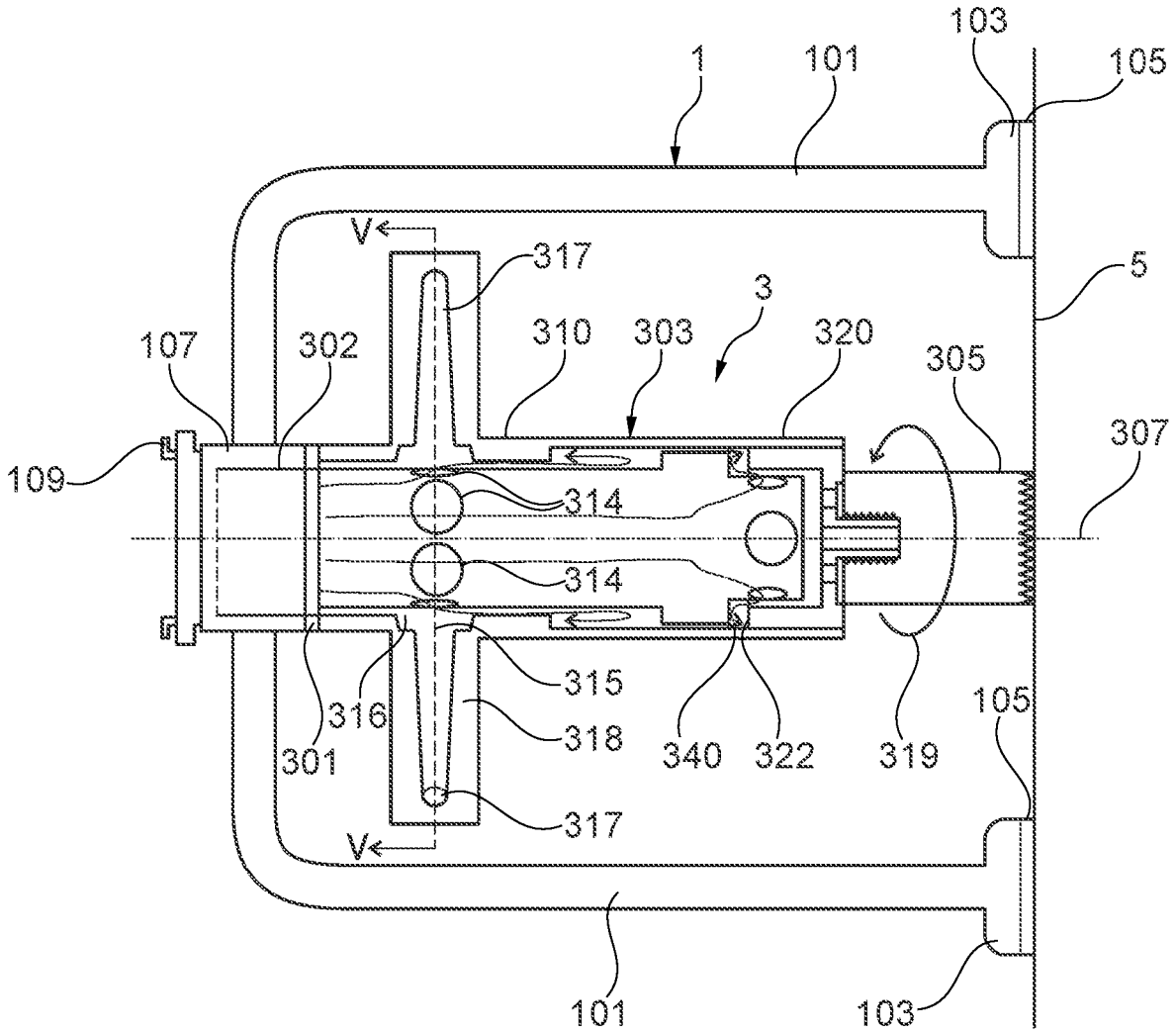

U.S. PATENT DOCUMENTS 2,857,005 A * 10/1958 Medlock ..... A62C 31/22 239/722
2,993,650 A * 7/1961 Badberg ..... B05B 1/14 239/443
3,865,194 A * 2/1975 Chatfield, Jr. ..... A62C 31/22 239/271
4,147,216 A * 4/1979 Schnepfe, Jr. ..... A62C 31/22 239/271
4,271,909 A * 6/1981 Chatfield, Jr. ..... A62C 31/22 175/170
4,625,808 A * 12/1986 Halfpenny ..... A62C 31/22 169/30
4,676,319 A * 6/1987 Cuthbertson ..... A62C 31/22 239/271
4,697,740 A * 10/1987 Ivy ..... A62C 31/22 169/70
5,284,298 A * 2/1994 Haynes ..... B05B 3/001 239/254
5,351,891 A * 10/1994 Hansen ..... B05B 3/001 239/271
5,368,106 A * 11/1994 Coughlin ..... A62B 3/005 169/70
5,461,874 A * 10/1995 Thompson ..... F41B 9/00 169/36
5,577,561 A * 11/1996 Cook ..... A62C 31/22 239/271
5,651,417 A * 7/1997 Coughlin ..... A62B 3/005 169/70
5,857,623 A * 1/1999 Miller ..... B05B 3/06 239/560
6,340,060 B1 * 1/2002 Larsson ..... A62C 31/22 239/165
6,755,259 B2 * 6/2004 Peltola ..... A62C 31/22 239/271
9,423,223 B2 * 8/2016 Beckman ..... F42B 15/01
9,630,038 B2 * 4/2017 Chan ..... B23B 45/042
2003/0230414 A1 * 12/2003 Peltola ..... A62C 27/00 169/47
2005/0252989 A1 * 11/2005 Carpenter ..... A62C 31/22 169/70
2011/0121099 A1 * 5/2011 Han ..... B05B 7/0425 239/263
2015/0246251 A1 * 9/2015 Mikota ..... A62C 31/22 169/70
2015/0306437 A1 * 10/2015 Hunter ..... B05B 3/1021 239/264
2016/0166865 A1 * 6/2016 Chan ..... A62C 27/00 169/70
2017/0291050 A1 * 10/2017 Boyle ..... A62C 2/06
2019/0344108 A1 * 11/2019 Rosenfeldt ..... B66F 11/042

FOREIGN PATENT DOCUMENTS

CN 103751932 A 4/2014
CZ 20110170 A3 10/2012
EP 2420293 B1 3/2008
FR 2854576 A1 11/2004

OTHER PUBLICATIONS

Singapore Search Report dated Nov. 5, 2020 in SG Application No. 11201904237U, 3 pages.
International Search Report and Written Opinion dated Mar. 29, 2018 in International Application No. PCT/DK2017/050378.
European Search Report dated May 3, 2017 in European Application No. 16199101.

* cited by examiner

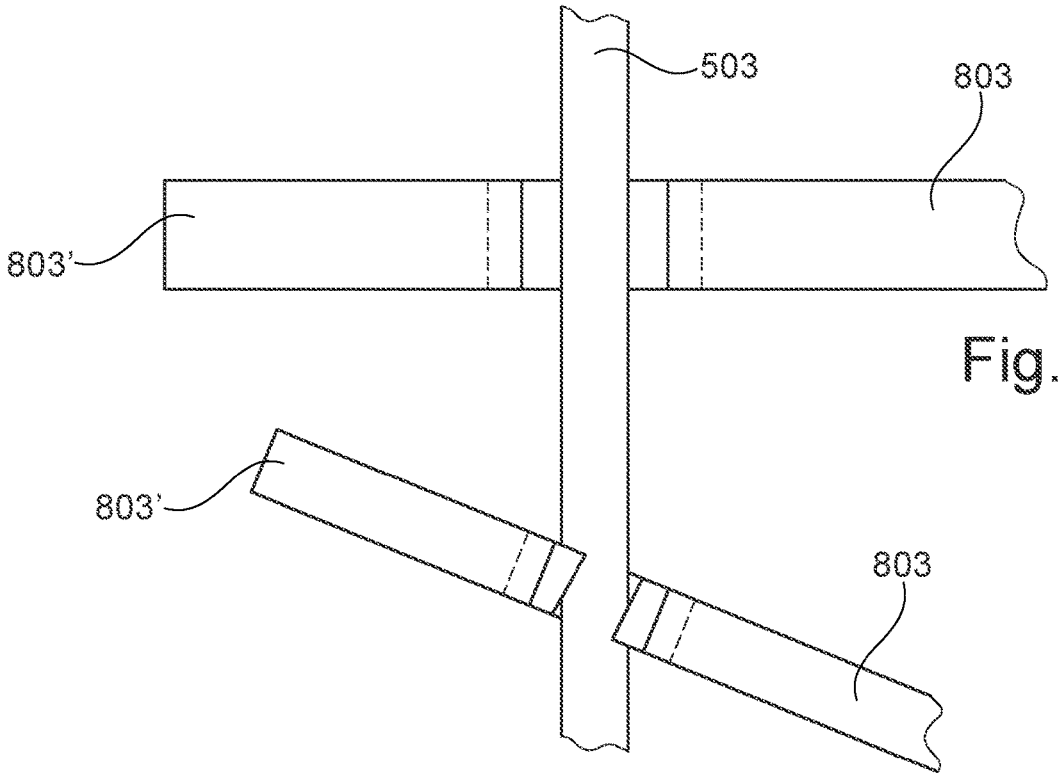
Fig. 10b
Fig. 10c
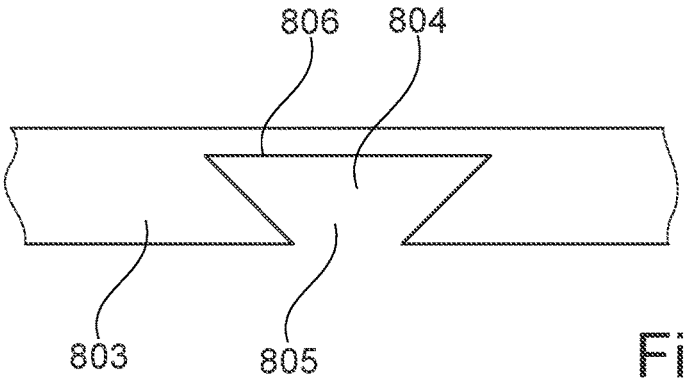
Fig. 10d

FIRE FIGHTING DEVICE

CROSS REFERENCE TO RELATED APPLICATIONS

This application is a National Stage Application of International Application No. PCT/DK2017/050378, filed Nov. 16, 2017; which claims the benefit of and priority to European Application No. 16199101.3, filed Nov. 16, 2016; and European Application No. 17192104.2, filed Sep. 20, 2017. The entire specifications and figures of the above-referenced applications are hereby incorporated in their entirety by reference.

The present invention relates to a fire fighting device with a fire fighting aggregate for penetrating a wall and injecting fire fighting fluid into a space behind the wall, said fire fighting aggregate comprising a fluid driven rotating motor, such as a turbine, having a rotor rotating around an axis of rotation defining an axial direction, a rotating cutting element attached to the rotor to be rotated thereby, a fluid inlet for receiving fire fighting fluid from a source of fire fighting fluid, and a first conduit for feeding the fire fighting fluid from the fluid inlet to the rotor to drive the fluid driven rotating motor.

FR2854576 A1 discloses a fire fighting device of the above kind in which the fluid driven rotating motor is a turbine. The device is attached to the end or nozzle of a fire hose whereby it is possible manually to cut a hole in a wall by means of the rotating cutting element and subsequently to spray fire fighting fluid (water) into the hole and into the space behind the wall since a central axial passage is provided through the device and the fluid or water leaving the turbine exits in part on a radius smaller than the radius of the hole.

U.S. Pat. No. 4,271,909 discloses another device comprising the feature mentioned by way of introduction and provided for manual operation.

US 2005/0252989 disclose another device used for fighting fires in for example rooms, attics and the like. The device is provided with a water driven auger and a spray nozzle arranged for rotation relative to a housing. The firefighter places the tip of the auger against the surface or separation which it is desirable to penetrate in order for the nozzle to reach the fire. A handle is provided which the firefighter uses to control and force the tip of the auger against the surface. By the firefighter applying sufficient downforce in combination with the water rotating the auger, the device will drill itself through the separation, and water issuing from the spray nozzle will quell or dampen the fire. Once the device has penetrated the separation, the device may be fastened to the surface, and be operated and controlled remotely.

CZ2011-170 relates to an extinguishing and penetration unit in which a drilling unit (22) is connected with a spraying head (1) provided with a drilling and centering pin (2) being coupled through the mediation of a freewheeling clutch (5) by one end of an internal hollow shaft (3), whereby the other end of the internal hollow shaft (3) is provided with a rotary supply (8) of extinguishing water. The internal hollow shaft (3) of the drilling and centering pin (2) is supported by a pair (6) radial antifriction bearings and one axial antifriction bearing (7) being all mounted by their outer surfaces within an external hollow shaft (9). The external hollow shaft (9) is provided in its central portion with external grooves (10) and in front of the grooves (10), in the direction toward the spraying head (1), there is a section with an external motion thread (11). An extensible tube (12) is mounted slidably in the external hollow shaft (9) provided with external grooves (10). The extensible tube (12) is provided at its end with internal feathers (13) and an internal motion thread (14) of the extensible tube (12) wherein the extensible tube (12) is fixedly coupled with a core boring crown (15). The external hollow shaft (9) is supported by a radial-axial bearing (20) that is mounted in a frame (19) of the extinguishing and penetration unit. One side of the internal hollow shaft (3) is fixedly coupled with a pin toothed wheel (16) which engages with a first section (4) of the pin hydraulic motors, which section is fixedly coupled through the mediation of a cage (21) with the frame (19). The toothed wheel (17) of the boring crown engages with the second section (18) of the crown rotary hydraulic motors, which are fixedly coupled through the mediation of the cage (21) with the frame (19).

In certain circumstances the may be fire in a place which is difficult to reach for a fire fighter e.g. a fire in a container on board a ship where containers are stacked relatively closely and to a considerable height.

The object of the present invention is to provide a fire fighting device which need not be held by an operator during operation.

This is obtained by a device as mentioned by introduction which comprises a support for attachment to the wall, wherein the fire fighting aggregate is suspended by said support, at least the rotating cutting element being movable relative to the support towards the wall, a power means is provided for pressing the rotating cutting element towards the wall, and a second conduit is provided for feeding the fire fighting fluid to the power means to provide for said power means to press the rotating cutting element towards the wall. Hereby is obtained that the fire fighting device may be brought into position, e.g. by means of a hoist of any kind, with e.g. a fire hose connected to the fluid inlet and be attached to the wall, whereafter the device automatically cuts hole in the wall. Further it is obtained that a hole may be cut for introduction of fire fighting fluid into a space behind a wall without the need for any other energy source than the pressurised fire fighting fluid.

The fire fighting fluid may be water and the source of fire fighting fluid may be a fire hydrant. Accordingly, the fire fighting device may comprise a connector for connecting a fire hose to the device.

When attaching for use of the fire fighting device the support to wall to be penetrated, the support may in an embodiment of the invention be fastened directly to the wall or it may be fastened to a rigid structure fixed relative to the wall or attached to the wall, said structure preferably having a distance from the wall less than 1 meter, preferably less than 50 cm, and especially within 10 cm or within 5 cm from the wall.

The direction of the movement of the rotary cutting element towards the wall may be generally parallel or co-axial with the axial direction.

In an embodiment the fluid driven rotating motor comprises a stator attached to the support, the rotor being seated for rotation on said stator, the rotor comprises a driving part and a driven part the driving part driving rotary the driven part, wherein the rotary cutting element is attached to the driven part. It should be noted that as used herein "stator" designates a generally non-rotating part of the fluid driven rotating motor as opposite to the "rotor" which a part of the fluid driven rotating motor rotating during operation of the fluid driven rotating motor.

In a further embodiment the driven part is displaceable in the axial direction from a retracted position to an extended position together with the rotating cutting element and comprises a surface element constituting part of the power means, said surface element being subject to a pressure of the fire fighting fluid through the second conduit to press the rotating cutting element towards the wall.

In a further embodiment the stator and the driven part between them define an annular chamber receiving fire fighting fluid through the second conduit, said annular chamber being defined by a first external cylindrical surface of the stator, a first internal cylindrical surface of the driven part, an annular surface of the stator adjacent to the first external cylindrical surface, and said surface element constituted by an annular surface part of the driven part adjacent to the first internal cylindrical surface. Hereby is obtained that the annular chamber provides the power means generally in the form of a power cylinder.

In a further embodiment the second conduit extends through the stator and out through at least one first aperture in the first external cylindrical surface. Hereby fluid pressure is provided for the annular chamber.

In an embodiment at least one nozzle opening at the rotating cutting element is provided for ejecting fire fighting fluid, and an adjustable valve adjustable between an open position and a closed position is provided, whereby the adjustable valve in the closed position at least throttles a flow of fire fighting fluid to said nozzle opening.

In a further embodiment the driven part comprise an end comprising a cylindrical end chamber extending from said annular surface part, said cylindrical end chamber accommodating an end of the stator comprising at least a part of the first external cylindrical surface, when the driven part is in the retracted position, said end part of the stator being out of the cylindrical end chamber when the driven part is in the extended position, said first external cylindrical surface fitting slidably in said cylindrical end chamber, and wherein said cylindrical end chamber comprises a fluid outlet. Hereby such valve is provided since fluid may flow freely to the fluid outlet when the end part of the stator being out of the cylindrical end chamber, while flow of the fluid towards the fluid outlet is at least restricted when the end part of the stator is inserted in the cylindrical end chamber.

In a further embodiment the rotating cutting element is attached co-axially to the driven part and at least one passage is provided to receive fire fighting fluid from the fluid outlet for said fire fighting fluid to be ejected into a hole cut by the rotating cutting element. Hereby is provided for the device to eject fire fighting fluid into the space behind the wall once the hole has been cut.

In a practical embodiment the stator comprises an annular protrusion with a second external cylindrical surface in sliding engagement with said first internal cylindrical surface, said annular protrusion comprising at one axial end said annular surface, said annular protrusion comprising at an opposite axial end a second annular surface, a third annular surface positioned opposite the second annular surface being connected to the first internal cylindrical surface, a second annular chamber thereby being provided between the second annular surface and the third annular surface, whereby either the area of the second annular surface part, and thus of the annular surface part of the driven part, is bigger than the area of the third annular surface as seen in the axial direction, or the second annular chamber is vented to the surroundings. Hereby the third annual surface may abut on the second annular surface when the driven part is in the extended position thus defining said extended position.

In an embodiment the driving part comprises a hollow shaft member, a number of nozzles extending from the hollow shaft member to eject fire fighting fluid fed to the rotor, the nozzles thereby ejecting the fire fighting fluid in a direction with a circumferential component in a plane perpendicular to the axial direction. Hereby is obtained that the driving part is driven rotationally in a direction opposite to said circumferential component. Thus the fluid driven rotating motor is provided generally in the form of a so-called Segner wheel or Segner turbine.

In an embodiment the stator comprises a circular cylindrical section which has a third external cylindrical surface and the driving part has a second internal cylindrical surface in sliding engagement with said third external cylindrical surface, the first conduit extends through the stator and out through at least one second aperture in the circular cylindrical section at the third external cylindrical surface at an axial position, the driving part at the second internal cylindrical surface comprises at least one third aperture for receiving fire fighting fluid from the first conduit, a circumferential recess defining an axial recess area is provided in one of the third external cylindrical surface and the second internal cylindrical surface, and the second aperture and the third aperture are opening into said circumferential recess when the driving part is in an axial starting position relative to the stator. Hereby is obtained a fluid connection between the non-rotating stator and the rotating driving part of the rotor.

In an embodiment an adjustable valve is attached to the first conduit, said adjustable valve being adjustable between an open position and a closed position, whereby the adjustable valve in the closed position at least throttles a flow of fire fighting fluid to the rotor.

In a further embodiment the driving part is displaceable in the axial direction relative to the stator from the axial starting position, which is a retracted position, to an extended position, whereby one of the second aperture and the third aperture is outside the axial recess area when the driving part is in the extended position. Hereby an adjustable valve opening and at least restricting the flow of fire fighting fluid to the rotor since said flow is at least restricted when one of the second and the third apertures are out of the axial recess area.

In an embodiment the driving part and the driven part are integrated. Hereby is obtained that the driving part and the driven part move in unison in the axial direction.

In a practical embodiment the stator is attached immovably to the support and the support is preferably rigid.

In an embodiment the support is provided with means for attachment to the wall, said means comprising one or more of: a magnet, a suction device, a hook, a claw, a pair of jaws, a clamp, etc. Hereby the attachment means may be adapted to the intended place of use of a specific fire fighting device according to the invention, e.g. on a ship container made of ferromagnetic steel and/or wherein bars are permanently mounted adjacent to a wall or door of the container, on a wall with a smooth surface, on a surface with protrusions adapted for engagement with hooks, claws, clamps, a pair of jaws, etc. Hereby the stator will be fixed relative to the wall during use, when the support is rigid and the stator is attached immovably to the support.

The invention further relates to a method of using a device according to the invention, whereby the support is attached to a wall to be penetrated, a connection between a source of fire fighting fluid and the fluid inlet is provided, and opening said connection to provide a pressure of 2 to 50 bar, preferably 2 to 20 bar and more preferably 2 to 10 bar, of fire fighting fluid at said fluid inlet.

The invention is also directed at a hoist for use with a fire fighting device as disclosed above. The hoist comprises a telescopic section where said telescopic section has a lower end and an upper end and two or more concentrically arranged extendible sections there between, where in the upper end a fastening bar is arranged perpendicular to the extendible sections, and a pully wheel, where a wire is provided from adjacent the lower end around the pully wheel and back to the lower end, where said wire comprises means for fastening the fire fighting device to an end of the wire.

The hoist provides a number of advantages. Often, particularly with ISO containers being carried on freighters, they are stabled to a height where it is not possible for personnel to immediately reach the desired height.

For this purpose the hoist may be extended be extending the telescopic section such that the fastening bar is positioned at a desired height relative to the container in which it is desirable to extinguish the fire. The fastening bar is typically arranged perpendicular to the longitudinal extent of the telescopic section. In this manner it is possible to insert the fastening bar between the front of the container and the vertical bars which are typically part of the locking arrangement on ISO containers (see FIG. 6).

When the telescopic section including the fastening bar is installed against the surface on which it is desirable to place the fire fighting device, the fire fighting device is attached to the wire and hoisted up to the upper end of the telescopic section such that the fire fighting device will be positioned immediately adjacent the fastening bar and thereby in its operational position.

In order to ease the work with the hoist the hoist is in a further advantageous embodiment provided with a winch at the lower end such that it is possible to activate the winch in order to elevate the fire fighting device to the desired elevation. The winch may be manually or electrically operated.

In a still further advantageous embodiment the two or more concentric sections may be extended by applying a force to the lower ends of each section, where said force is generated by one or more of the following: electrical motor means, hydraulic or hydro means, pneumatic means, mechanical means in the shape of a winch, releasable gas springs.

As it is foreseen that the concentric sections may be extended to a relatively high elevation, for example 15-20 meters, it may become difficult to handle this extension by hand. Therefore, by providing a force to extend the concentric sections this work is eased.

Generally, the force may be generated by electrical motor means which in addition to being a well-known technology is easy to install, easy to handle and furthermore electricity is present on most ships, and as such the source of energy is readily available. The alternatives, for example using hydraulic or hydro means, are also viable in that for example ships carrying containers will have a hydraulic system for other reasons and as such it is possible to hook up to the existing hydraulic system and thereby convert the hydraulic system to the force necessary to extend the concentric sections.

As the fire fighting device is using a fire fighting liquid which is typically water, water is available anyway in connection with the hoist when used together with a fire fighting device and as such by diverting part of the water pressure to be used as the force extending the concentric sections is a straightforward and available solution. As is the case with hydraulic means most ships of the type carrying containers will also have pneumatic installations such that it is possible divert a pressurized hose, for example with pressurized air, to the concentric sections and thereby elevate the concentric sections by supplying the force by means of air.

As already a winch in some embodiments may be installed in order to elevate the fire fighting device to the upper end of the hoist the same winch or an additional winch may be used in order to provide the force pushing up the concentric sections.

As an extra safety measure the hoist may in a further advantageous embodiment be provided adjacent the upper end of the hoist with a releasable locking mechanism where said locking mechanism is suitable to interact and lock the fire fighting device in position adjacent the upper end of the hoist. The locking means may for example be a spring loaded tab which as the fire fighting device passes the place where the tab is present pushed the tab into the hoist, and as the fire fighting devise passes the tab, an aperture in the fire fighting device may release the spring force, whereby the tab is inserted into the aperture such that the fire fighting device is locked relative to the hoist.

Naturally, the underside of the fire fighting device will also release the tab such that the fire fighting device may be resting on the tab. When desiring to free the fire fighting device from the engagement with the tab internal means, for example in shape of a wire threaded pulley, and operational from the lower end of the hoist, may be used in order to release the locking mechanism.

Another alternative locking mechanism may be a pivotable member which may pivot out of the perimeter of the hoist as the fire fighting device has passed and thereby creating a lock such that the fire fighting device cannot slide back down the hoist. When it is desirable to release the lock the fire fighting device is elevated slightly, or the hoist is lowered slightly relative to the fire fighting device which due to the engagement with the fastening bar to the side of the container is locked in place allowing the hoist to be lowered such that the releasable locking mechanism in the shape of a pivotal member may be pivoted back inside the perimeter of the hoist whereby it is possible to lower the fire fighting device along the hoist.

The invention is also directed at a method of using a fire fighting device as discussed above in order to quell a fire in an object at an elevated position where a hoist as also discussed above is used in order to elevate the fire fighting device to the desired position in which it is desirable to apply the fire fighting device against the object. This method comprises the following steps:

- the fire fighting device is attached to a free end of the wire;
- the telescopic section is extended, such that the fastening bar arrives at the desired height where the fire fighting device is to be applied;
- the fastening bar is brought into engagement adjacent the elevated position;
- the fire fighting device is hoisted up to the elevated position and releasably locked into position;
- fire fighting liquid is supplied to the fire fighting device which thereafter cuts into the object, and injects the fire fighting liquid into said object.

In this manner the fire fighting device together with the hoist constitutes a very effective overall fire fighting device regardless of the height where the object is positioned such that it is possible to position the effective fire fighting device manually and relatively easily at a desired elevation.

Figure 2:
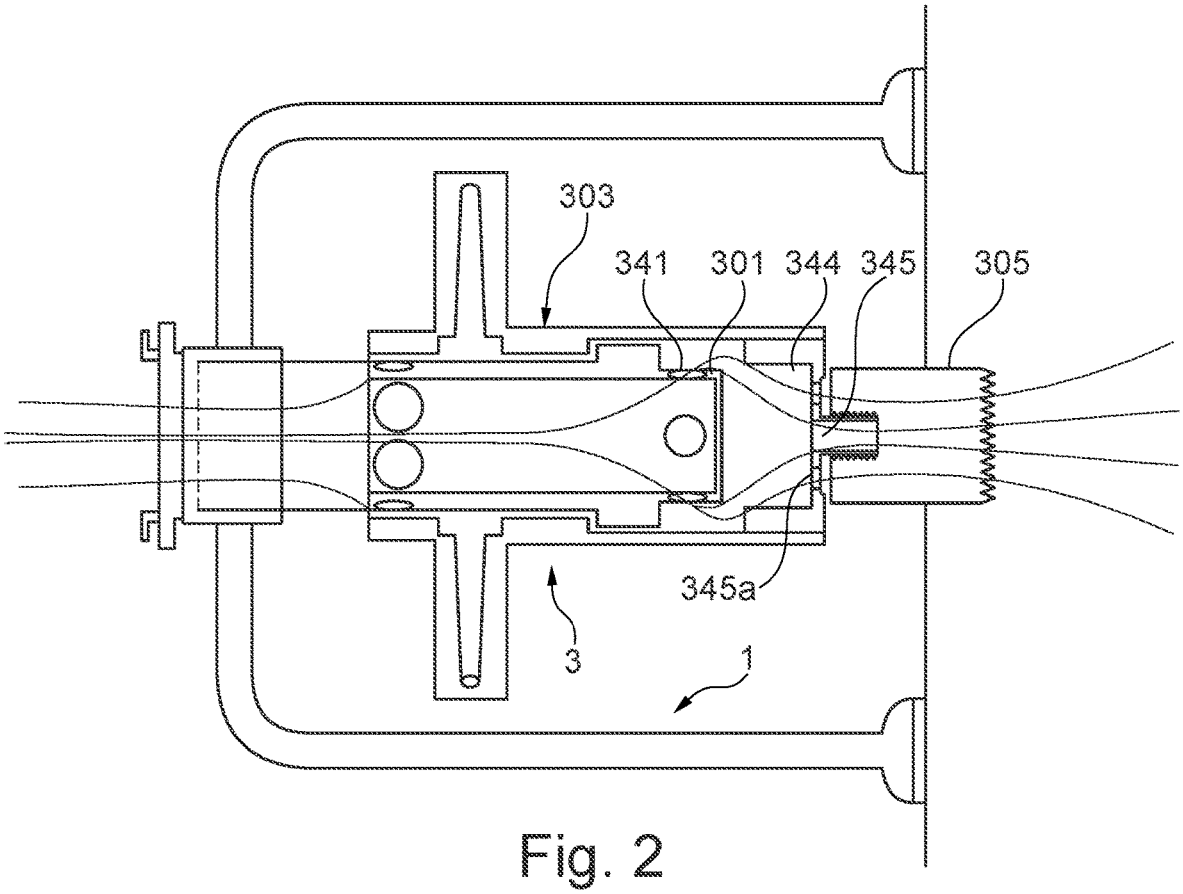
Figure 3:
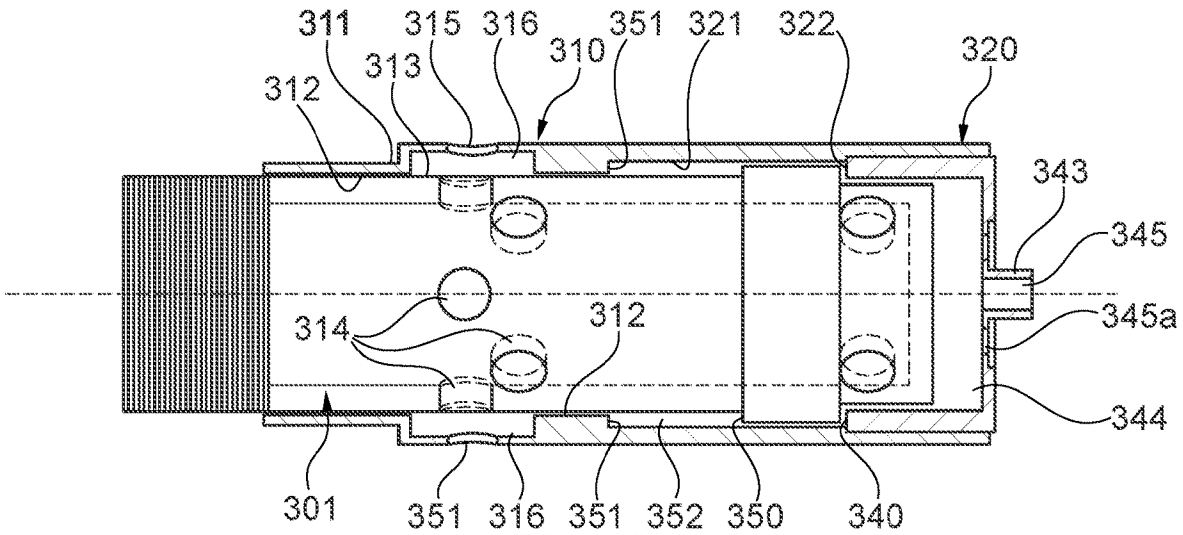
Figure 4:
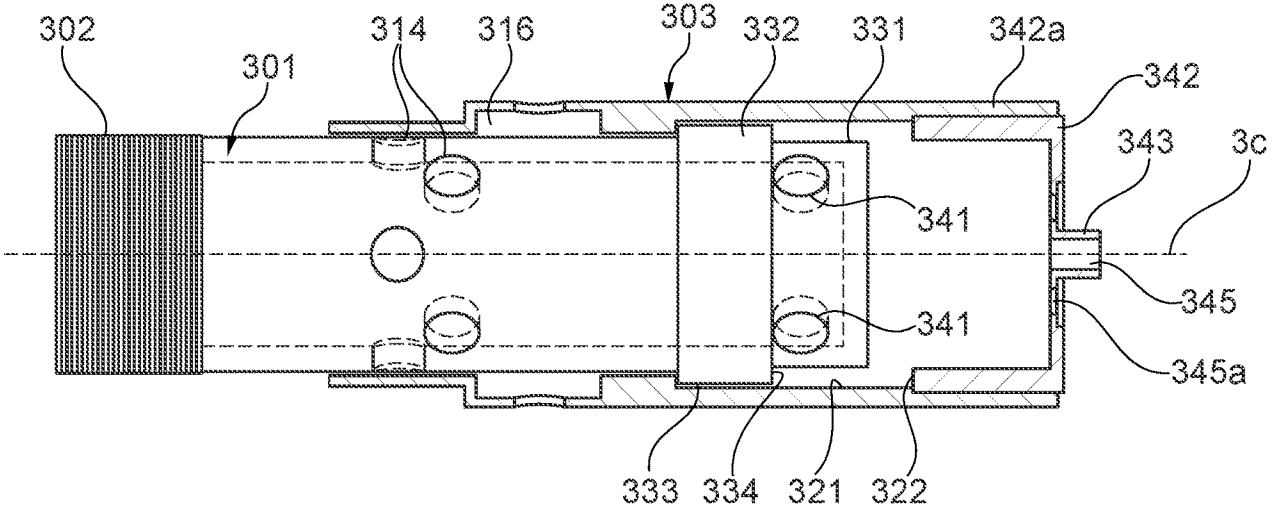
Figure 5:
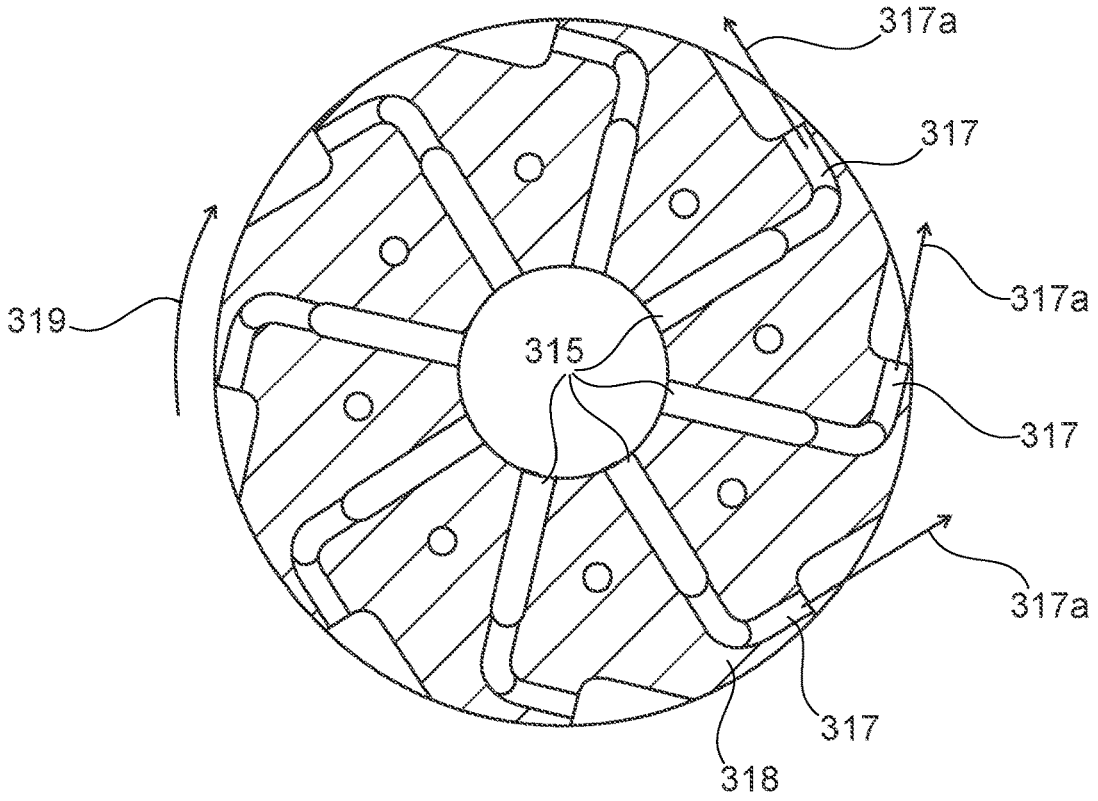
Figure 6:
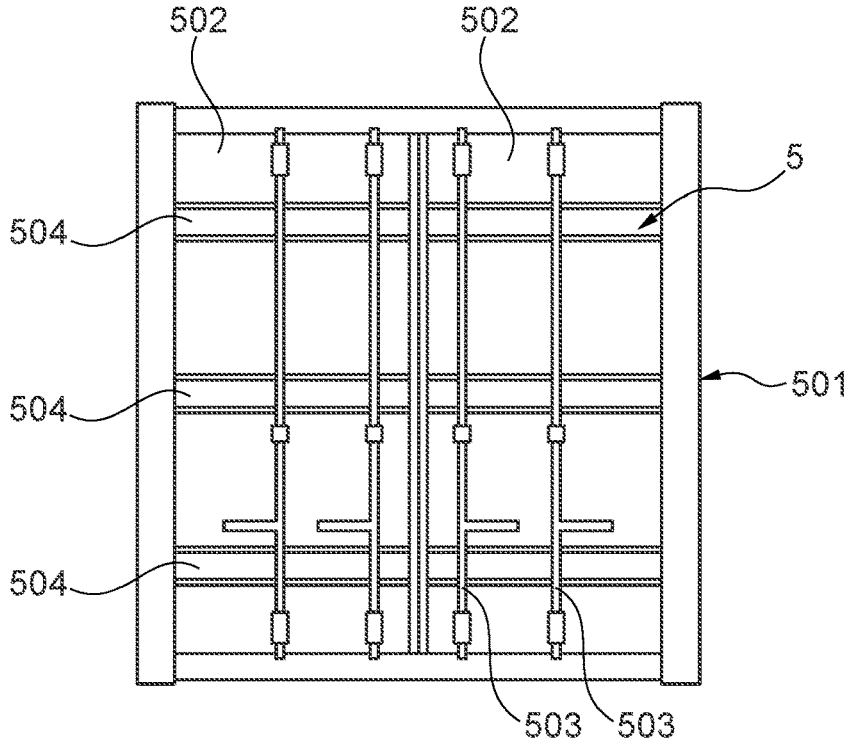
Figure 7:
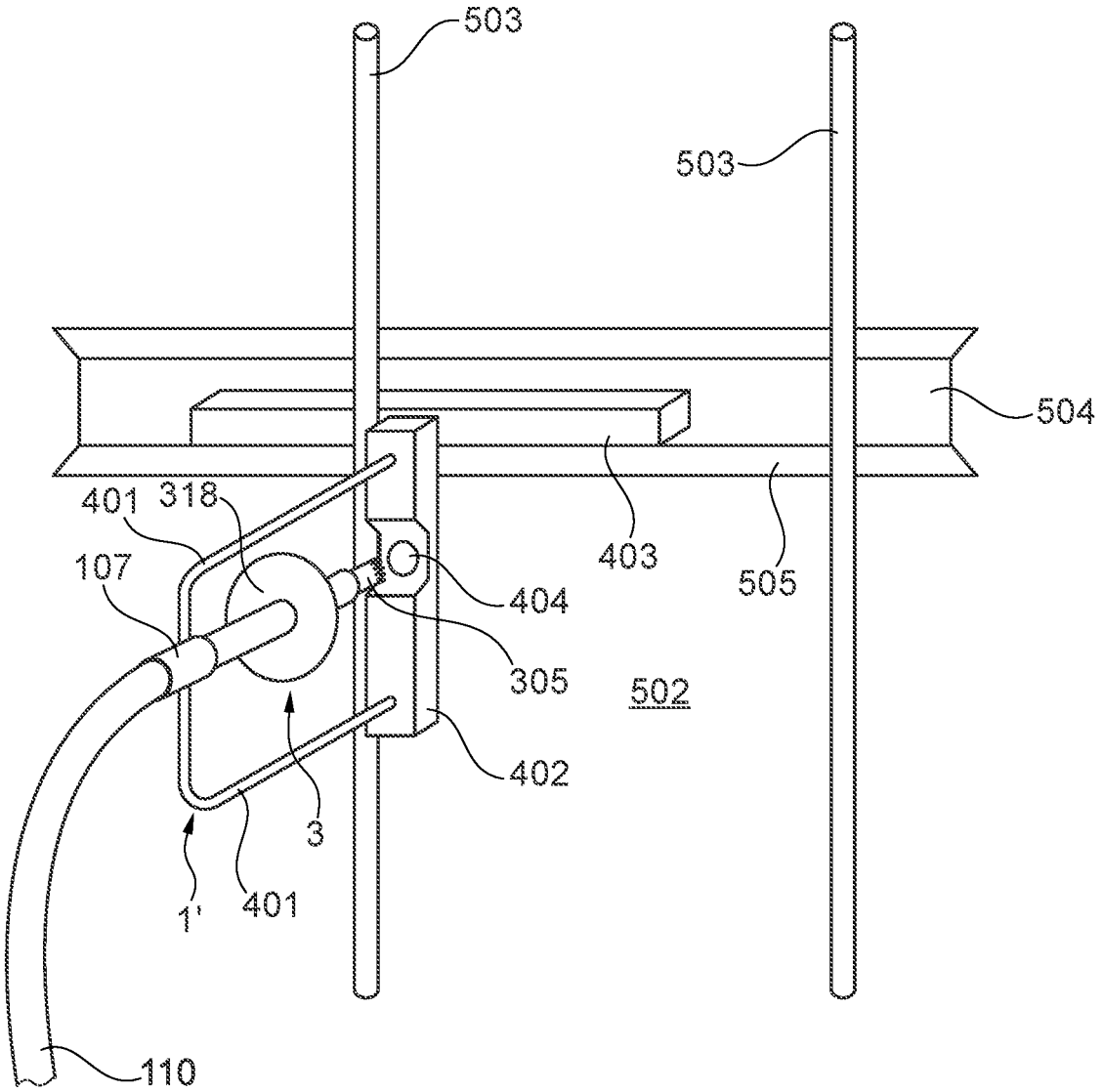

In the following the invention will be explained in further detail by way of example having reference to the accompanying schematic drawings, in which FIG. 1 shows schematically a device in an embodiment of the present invention in an axial starting position, FIG. 2 shows the device of FIG. 1 in an end position, FIG. 3 shows details of a device in an embodiment of the present invention in the axial starting position, FIG. 4 shows details of the device of FIG. 3 in the end position, FIG. 5 shows a section of a nozzle ring as indicated by V-V in FIG. 1, FIG. 6 shows schematically an end of a ship container, and FIG. 7 illustrates an embodiment of means for attachment to a wall.

Figure 8A:
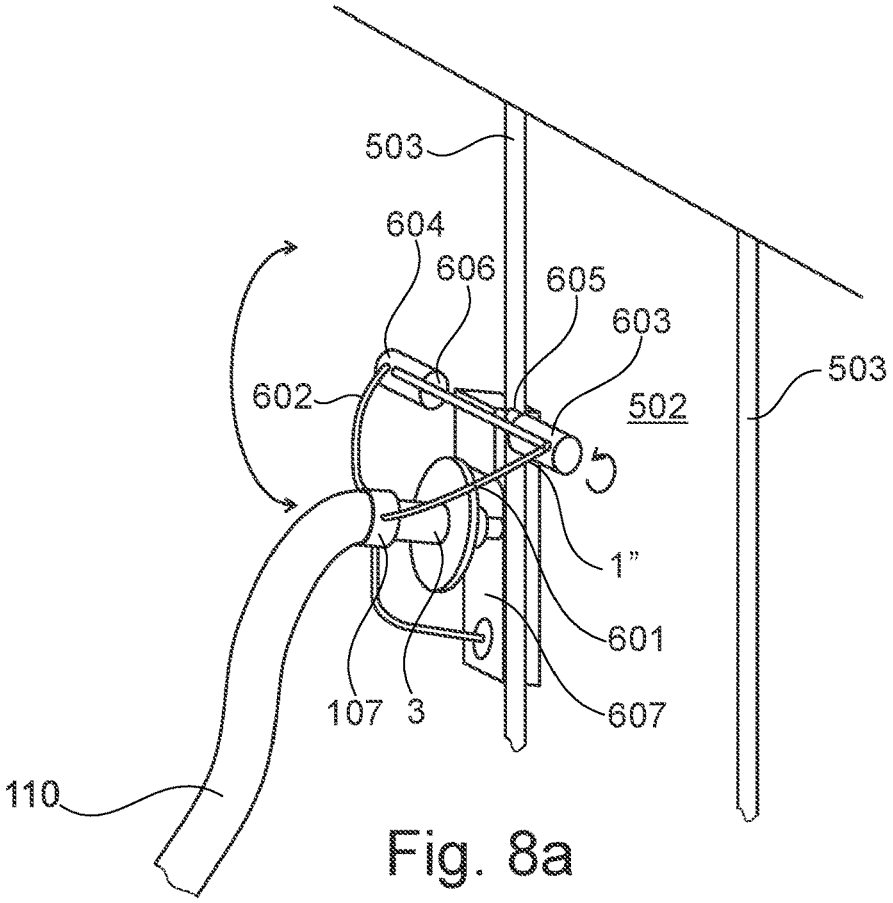
Figure 8B:
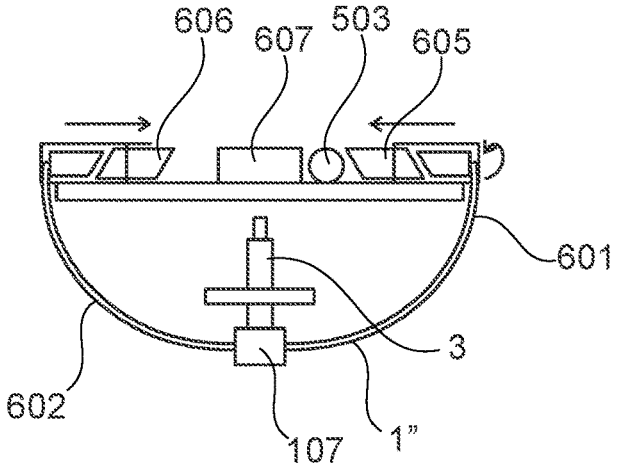
Figure 9:
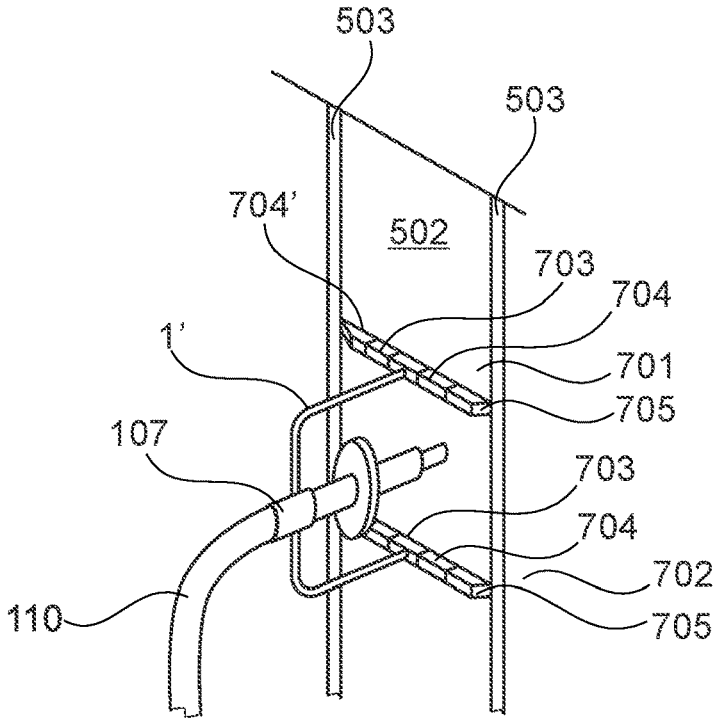
Figure 10A:
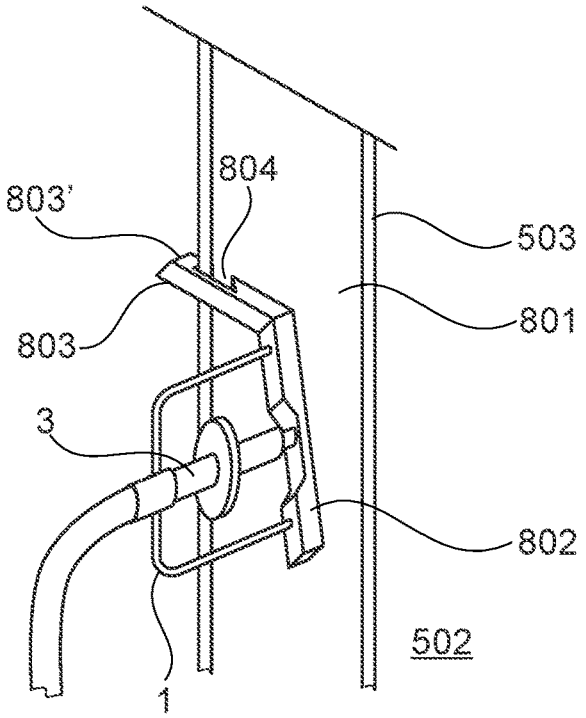
Figure 11:
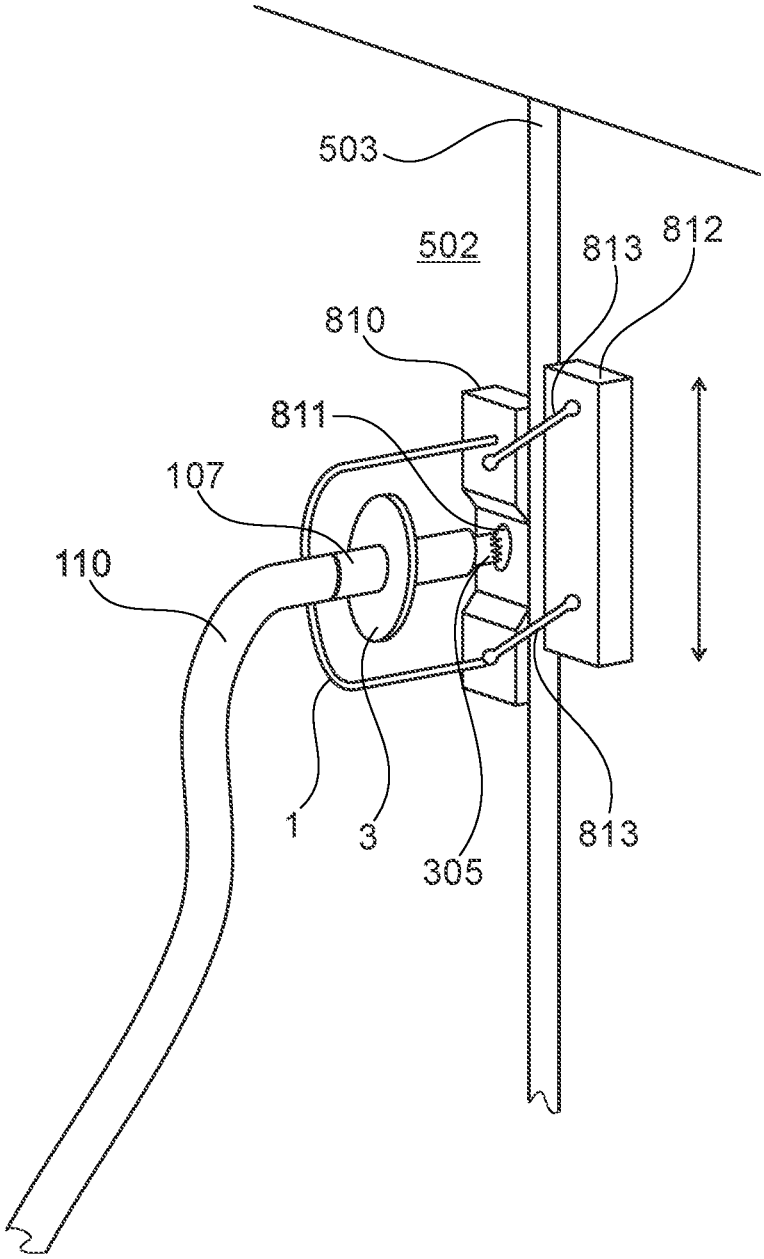
Figure 12A:
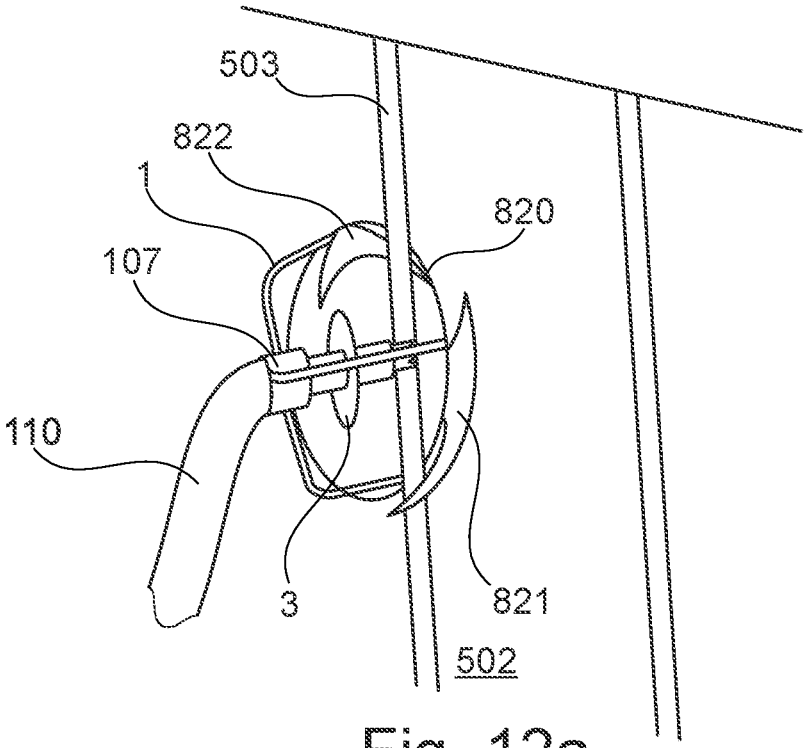
Figure 12B:
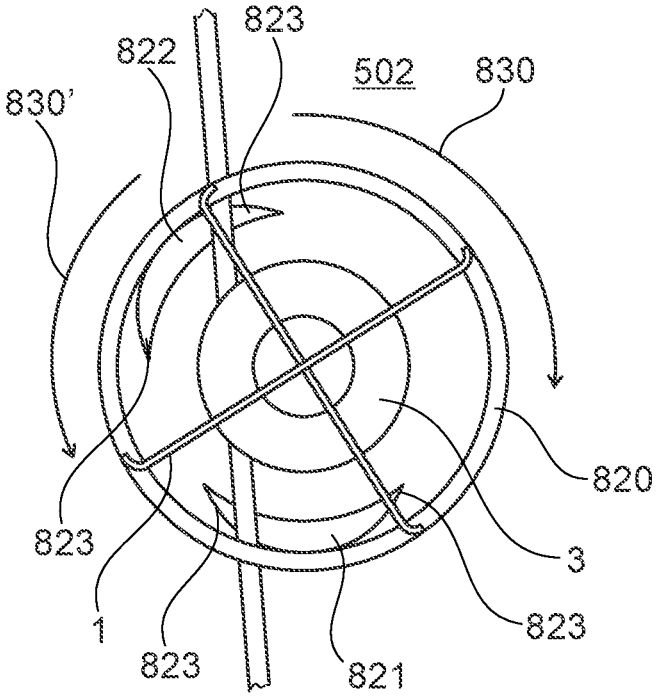
Figure 13:
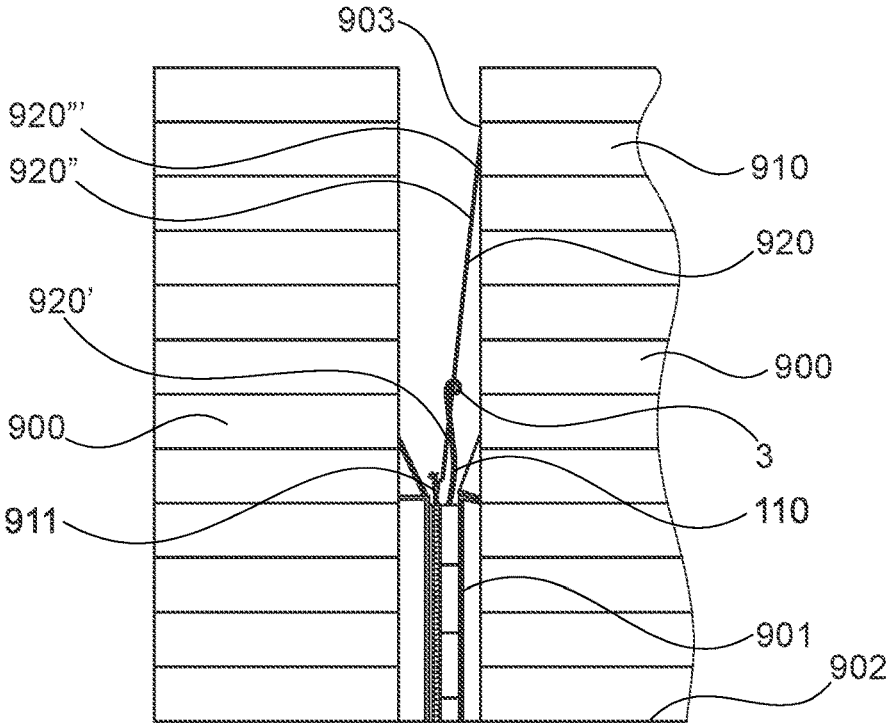
Figure 14:
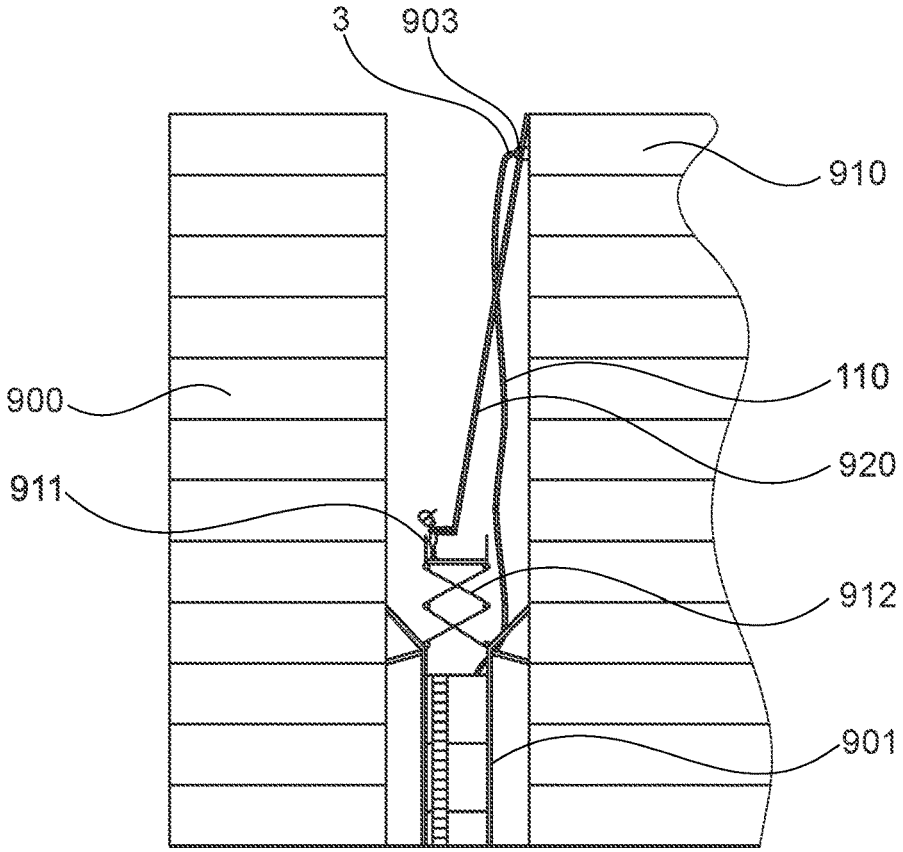
Figure 15:
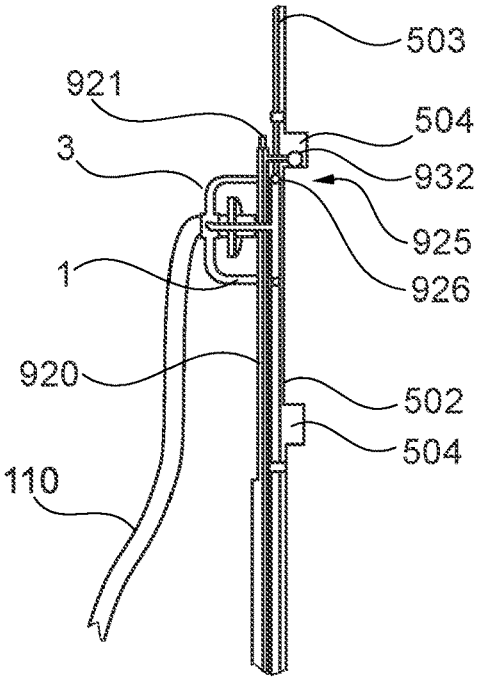
Figure 16:
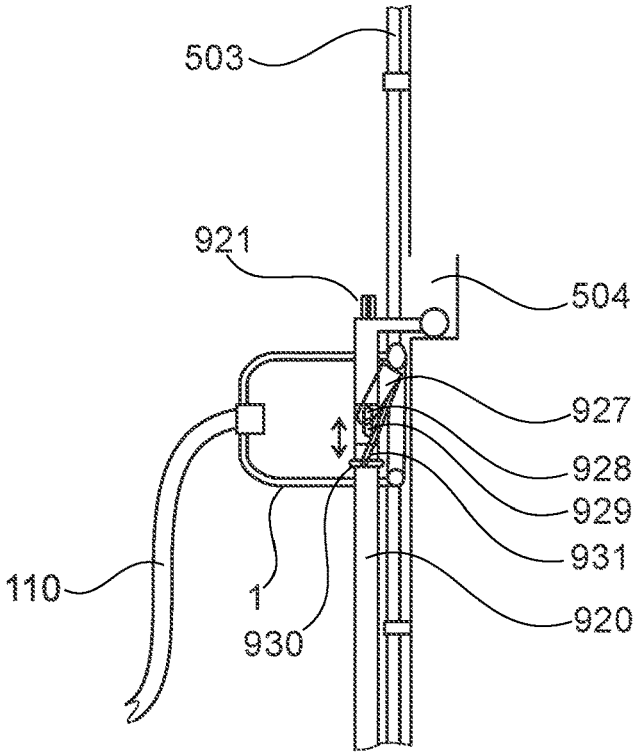

FIGS. 8A and 8B illustrate a further way of attaching the support to the wall to be penetrated FIG. 9 illustrates a further way of attaching the device to the wall FIG. 10 illustrates further ways of attaching the device to the wall by means of the vertical bars FIG. 11 illustrates a further manner in which to attach the device to a vertical bar FIGS. 12*a* and 12*b* illustrate a further embodiment of how to attach the device to a wall by means of the vertical bars FIGS. 13 and 14 illustrate the use of the hoist in fire-fighting situations, FIGS. 15 and 16 illustrate to different principles of arresting the firefighting device in the upper end of the hoist.

The figures show an embodiment of a fire fighting device which comprises a support 1 and a fire fighting aggregate 3. The fire fighting device is attached to a wall 5 which is to be penetrated for ejecting a fire fighting fluid into a space behind the wall.

For ease of description the fire fighting fluid will in the following be generally referred to as "water", since water, of the quality available, will in many cases be the actual fluid used as fire fighting fluid.

For sake of explanation the end of the device, or parts thereof, closest to the wall 5 during use is designated "front end" and the opposite end is designated "rear end". Correspondingly as used herein "forward" designates a direction from the rear end towards the front end and "rearward" designates the direction opposite to "forward", etc.

As used herein "a wall" should be interpreted as any flat element defining a space into which water should be sprayed to fight a fire, thus including e.g. a door, a roof, a floor, etc.

In the following like reference numerals are used for like parts.

Referring to FIGS. 1 to 5, the support 1 comprises a number of legs 101 provided with feet 103 for abutment against the wall 5 to position the fire fighting device. The support is provided with means for attachment to the wall said means being in the present embodiment permanent magnets 105 attached to the feet 103 since the fire fighting device in the present embodiment is intended for use in fighting fires in steel containers e.g. on board a container ship. The support 1 further comprises a tubular connector 107 with an internal thread for receiving a threaded end of a stator 301 of the fire fighting aggregate 3. The tubular connector 107 is in the present embodiment provided with a fire hose connector 109 for connecting a fire hose 110 (see FIG. 7), the fire hose connector 109 thus providing a fluid inlet of the fire fighting device.

Though in the schematic drawings only two legs 101 of the support 1 are shown it should be understood that the support 1 in practice comprise a number of legs that will provide for a stable attachment of the device to the wall.

The fire fighting aggregate 3 comprises, apart from said stator 301, a rotor 303 and a rotating cutting element 305 all three of which are aligned on an axis of rotation 307 of the rotor 303. Thus in the embodiment shown the rotating cutting element 305 is rotating coaxially with the rotor 303. The rotating cutting element 305 is shown to be a hole saw, but any device might be use provided that is suitable for trepanning or drilling a hole of a certain diameter in the material of a wall for which the fire fighting device might be intended to be used.

The rotor 303 comprises a driving part 310 and a driven part 320. In the present embodiment the driving part 310 and the driven part 320 are integrated and accordingly they move in unison both in rotation around the axis of rotation 307 and in translation along said axis.

The stator 301 is a generally tubular body and is as mentioned above threaded i.e. at its rear end and is through the thread 302 connected to the tubular connector 107. Hereby the stator 301 is attached to the support 1 to be immovable relative to the wall 5 during operation. Extending forwards from the thread 302 the stator 301 comprises three circular cylindrical sections, which counted from the front end are designated first, second and third circular cylindrical section, respectively. At its front end the stator 301 has a closed end wall. However, apertures providing passages from an inner hollow of the tubular body to the outside are provided in the circular cylindrical sections as will be explained in the following.

The threaded rear end of the stator 301 is open to receive water supplied through a fire hose connected to the fire hose connector 109. Accordingly, the inner hollow of the tubular body of the stator 301 provides part of several conduits for feeding the water to various places in the device, i.e. a first conduit for feeding the driving part 310 and a second conduit for feeding the driven part 320, as it will be explained further below.

The rotor 303, including, in the present embodiment, the driving part 310 and the driven part 320, comprises a likewise generally tubular body which is seated for rotation on the tubular body of the stator 301.

The driven part 320 comprises a first internal cylindrical surface 321 and an annular surface part 322 adjacent to the first internal cylindrical surface 321. The first circular cylindrical section of the stator 301 comprises a first external cylindrical surface 331. The extent of the second circular section is defined by an annular protrusion 332 which has a second external cylindrical surface 333. The second external surface 333 thus has a larger diameter than the first external surface 331. At a front end of the annular protrusion 332 the latter has an annular surface 334. When the fire fighting device is in the axial starting position shown in FIGS. 1 and 3 the first internal cylindrical surface 321, the annular surface part 322, the first external cylindrical surface 331 and the annular surface 334 between them defines an annular chamber 340 the function of which will be explained below.

In the present embodiment a number of first apertures 341 are spaced equidistantly around the first external cylindrical surface 331 to provide an opening between the inner hollow of the stator 301 and the annular chamber 340. The fire hose connector 109, the tubular connector 107, the inner hollow of the stator 301 and the first apertures 341 together provide what is arbitrarily designated the second conduit.

A front end of the driven part 320 comprises in the present embodiment a generally cup shaped plug member 342 which by means of an external thread 342*a* is threaded into an internal thread provided in axial extension of the first internal cylindrical surface 321. The cup shaped plug member 342 provides by a rim of the cup shape the annular surface part 322 at its rear end, and at its front end it comprises co-axially with the axis of rotation 307 a threaded tubular protrusion 343 onto which the rotating cutting element 305 is threaded. The cup shaped plug member 342 provides, extending from the rim, a cylindrical end chamber 344 of the driven part 320. The cylindrical end chamber 344 accommodates an end part of the stator 301 comprising at least a part of the first external cylindrical surface 331, when the driven part is in the axial starting position, which is a retracted position, as it will be explained below.

An inner hollow of the tubular protrusion 343 is extended through a bottom part of the cup shaped plug member 342 to provide a fluid outlet 345 allowing water in the cylindrical end chamber 344 to flow out of said chamber, and the inner hollow of the tubular protrusion 343 per se provides a passage for fire fighting fluid such as water to receive water from the fluid outlet 345 for said water to be ejected into a hole cut by the rotating cutting element, as it will be further explained below. Further outlet openings 345*a* are provided around the tubular protrusion 343 through the bottom part of the cup shaped plug member 342 and through corresponding openings in the rotating cutting element 305 (not shown).

The first external cylindrical surface 331 is fitting slidably in the cylindrical end chamber 344 and the first internal cylindrical surface 321 is fitting slidably on the second external cylindrical surface 333. Accordingly, the driven part 320 may slide on the stator 301 in rotation around the axis of rotation 307 as well in translation along said axis, as it will be explained further below with reference to the function of the fire fighting device.

The driving part 310 comprises a hollow shaft member 311 which comprises a second internal cylindrical surface 312 which is fitting slidable on a third external cylindrical surface 313 of the third circular cylindrical section of the stator 301.

The first conduit for feeding the driving part 310 extends through the fire hose connector 109, the tubular connector 107, the stator 301 and out through at least one, in the present embodiment six or eight, second apertures 314 in the third circular cylindrical section at the third external cylindrical surface 313 at an axial position. At the second internal cylindrical surface 312 the driving part 310 comprises at least one third aperture 315 for receiving water from the first conduit. A circumferential recess 316 defining an axial recess area is provided in the second internal cylindrical surface 312 and the second apertures 314 are opening into said recess 316, and the third apertures 315 are also opening into said circumferential recess 316 when the driving part 310 is in an axial starting position relative to the stator 301.

A number of nozzles 317 are extending from the hollow shaft member 311 to eject the water fed through the first conduit to the rotor 303. The nozzles 317 receive the water through the third apertures 315, and the nozzles 317 are ejecting the water in a direction with a circumferential component in a plane perpendicular to the axis of rotation 307.

The nozzles 317 are in the present embodiment provided by channels in a nozzle ring 318 shown in section in FIG. 5

In the present embodiment the driving part 310 is displaceable in the axial direction relative to the stator 301 from the axial starting position, which is a retracted position, to an extended position, whereby the second apertures 314 are outside the axial recess area defined by the recess 316, when the driving part 310 is in its extended position as seen in FIGS. 2 and 4.

Since the driving part 310 and the driven part 320 are in the present embodiment integrated and accordingly move in unison, the driving part 310 and the driven part 320 will be in their respective retracted positions and extended positions simultaneously, the axial position of driving part 310 being controlled by the axial position of the driven part 320.

The annular protrusion 332 of the stator 301 comprises at one axial end the annular surface 334, and said annular protrusion 332 comprises at an opposite axial end a second annular surface 350. A third annular surface 351 positioned opposite i.e. vis-à-vis the second annular surface 350 is connected to the first internal cylindrical surface 321. A second annular chamber 352 is thereby provided between the second annular surface 350 and the third annular surface 351. In the present embodiment the fire fighting aggregate 3 is constructed such that the area of the annular surface part 322 of the driven part 320 is bigger than the area of the third annular surface 351 as seen in the axial direction. In the alternative, or supplementary, the second annular chamber 352 might be vented to the surroundings.

In use the fire fighting device works as follows:

A fire hose is connected to the fire hose connector 109 and the fire fighting device is attached to a wall 5 which should be penetrated for water or another fire fighting fluid to be ejected through the wall 5 into a space behind the wall.

When attaching the fire fighting device to the wall 5 a supply of water to the fire hose 110 should not yet be turned on.

The rotor 303, including the driving part 310 and the driven part 320, will at this time be pushed to its axial starting position i.e. the retracted position shown in FIG. 1.

Now the water supply is turned on to supply water at a pressure of e.g. 2 to 10 bar to the fire fighting device. The water enters the fire fighting device through the fire hose connector 109 and the tubular connector 107 to follow the first and second conduit into the inner hollow of the stator 301 and out the second apertures 314 following the first conduit and also out through the first apertures 341 following the second conduit.

The water flowing out through the first apertures 341 fills the first annular chamber 340 and water flowing out through the second apertures 314 fills the circumferential recess 316.

Since respectively the first external cylindrical surface 331 is fitting slidably in the cylindrical end chamber 344, the first internal cylindrical surface 321 is fitting slidably on the second external cylindrical surface 333, and the second internal cylindrical surface 312 is fitting slidable on the third external cylindrical surface 313 the water is restricted but not prevented from flowing past said surfaces. In fact, a film of water with a thickness of e.g. 0.01-0.04 mm will be present between the respective surfaces fitting slidably with each other to provide a lubricating film facilitating movement of the rotor 303 relative to the stator 301. Further the water will flow into the second annular chamber 352.

The water is restricted from flowing between the first external cylindrical surface 331 and the cylindrical wall of the cylindrical end chamber 344 and into said cylindrical end chamber 344. Accordingly, the water will build up pressure in the first annular chamber 340.

The water in the circumferential recess 316 flows freely through the third apertures 315 and the nozzles 317 to be ejected by said nozzles 317 in directions 317*a* with a circumferential component in a plane perpendicular to the axis of rotation 307. This ejection of water will result in the rotor 303 being driven to rotate in an opposite direction of rotation 319 as it will be understood by the person skilled in the art, and the rotating cutting element 305 will thereby be driven to rotate likewise.

The water pressure building up in the first annular chamber 340 will act on the annular surface part 322 to expand said first annular chamber 340 and accordingly the rotating cutting element 305 will be pressed against the wall 5, the rotor 303 sliding axially on the stator 301. Thus the annular surface part 322 constitutes a surface element constituting part of a power means or a power cylinder.

Since the water also flows into the second annular chamber 352 it must be assured that any pressure building up in said chamber does not prevent the pressure in the first annular chamber 340 from expanding the latter to press the rotating cutting element 305 against the wall 5. This may as mentioned be obtained either by constructing the annular surface part 322 to have a larger area than the third annular surface 351, i.e. by constructing the first external cylindrical surface 331 with a smaller diameter than the third external cylindrical surface 313, and/or by venting the second annular chamber 352 to the surroundings, if it appears to be a problem: Thus the pressure in the circumferential recess 316 is relatively low since the water flows freely out the nozzles 317 and accordingly the pressure in the second annular chamber 352 may appear to be smaller than the pressure in the first annular chamber 340.

During the rotation of the rotating cutting element 305 the latter cuts its way through the wall 5 and accordingly the rotor 303 is axially displaced in what has been defined as the forward direction. The fire fighting device should be dimensioned relative to the thickness of walls which the device is meant to penetrate so that, before the forward end of the stator 301 is completely withdrawn from the cylindrical end chamber 344, the rotating cutting element 305 has cut through the wall 5 allowing the rotor 303 to slide axially with only little resistance to the extended end position shown in FIG. 2. In this extended end position, the third annular surface 351 abuts on the second annular surface 350 thereby defining the extended end position.

When the rotor 303 is in the extended end position the second apertures 314 are outside the circumferential recess 316 and the water is restricted from exiting the second apertures 314, the first conduit having thus been generally shut. Thus the water substantially stops flowing through the nozzles 317 and the rotor 303 stops rotating. The forward end of the stator 301 has in this extended end position been completely withdrawn from the circular end chamber 344 and the water is free to flow from the first apertures 341, past the forward end of the stator 301, through the circular end chamber 344, through the fluid outlet 345, and through the threaded tubular protrusion 343 to be ejected into the space behind the wall 5. Likewise, the water flows from the circular end chamber 344 through the further outlet openings 345*a* to be eventually ejected into the space behind the wall 5.

FIG. 6 shows schematically an end of a ship container 501 known per se. The ship container comprises two doors 502 which may constitute the wall 5 to be penetrated in case of a fire inside the container. In front of each door 502, as it will be familiar to the skilled person, two vertical bars 503 are present, said bars 503 constituting part of a locking arrangement for locking the doors 502 and are usually positioned at a distance of 2.5 to 3.5 cm from the main surfaces of the doors. A number of grooves 504 with a generally trapezoid cross-section are recessed in the main surfaces of the doors 502 as it will be familiar to the skilled person.

When the doors 502 of the ship container 501 are made of ferromagnetic material a fire fighting device as described above including feet 103 with permanent magnets 105 may be attached directly to a surface of one of the doors 502 the permanent magnets 105 cohering to the door 502.

Alternatively, the support 1 may be provided with other means for attachment to the wall 5, such means alternatively comprising one suction devices, which might provide for attachment directly to the surface of the wall 5 or door 502 or such means for attachment might comprise one or more hooks, claws, pairs of jaws, or clamps, which might be attached to one or more of the bars 503.

FIG. 7 shows a very simple way of attaching the support to the wall to be penetrated. Thus FIG. 7 shown schematically the fire fighting aggregate 3 suspended in a variant of the support 1' which comprises two legs 401 fixed to a vertical bar 402. An upper end of the vertical bar 402 is fixed to a horizontal bar 403 in an overlaying manner as shown in FIG. 7 and the vertical bar 402 comprises a recess with a through hole 404 for the rotating cutting element 305 to pass through. For attaching the fire fighting aggregate 3 suspended in the support 1' the horizontal bar 403 is simply inserted between the two bars 503 and into one of the grooves 504 whereafter the fire fighting aggregate 3 and the support 1' are shifted laterally in a longitudinal direction of the groove 504 until the vertical bar 402 abuts one of the bars 503 as shown in FIG. 7. The engagement of the horizontal bar 403 with a lower side wall 505 of the groove 504 and with the bar 503 and the engagement of the lower end of the vertical bar 402 with the main surface of the door 502 will keep the fire fighting aggregate 3 securely in place during operation. It is seen that the horizontal bar 403, though straight, functions as a hook hooking behind the bar 503. It is noted that especially the vertical bar 402 might be constructed differently from what is shown in FIG. 7 as long as the support 1' comprises an element extending vertically (in the use position) to be fixed to the horizontal bar, to be able to abut on a surface below the groove 504, and to allow the rotating cutting element 305 to pass to the surface of the wall to be penetrated.

Thus the device may be attached directly to the wall to be penetrated of to a structure which is in a fixed position relative to the wall, preferably within a distance of 1 meter from the wall and especially within 10 cm or within 5 cm.

The bars 503 and groove 504 illustrated in FIGS. 6 and 7 are typically part of a door construction of a typical ship's container. The invention, although not limited to use with containers and in particular the type of containers being used very widely for sea transport the following examples will be discussed with reference to a construction similar to the construction illustrated in FIG. 7 containing substantially vertical bars 503 and a substantially horizontal groove 504.

In FIGS. 8A and 8B is illustrated a further way of attaching the support to the wall to be penetrated. A variant of the support 1" is connected to the device 3 where the tubular connector 107 is connected to the firehose 110.

Two of the arms 601, 602 are liquid conduits such that part of the water being led by the firehose 110 to the device 3 is diverted into the arms 601, 602. The arms 601, 602 are in the opposite end to where they are connected to the tubular connector 107 connected to respective hydraulic cylinders 603, 604. The hydraulic cylinders 8 have a piston 605, 606 (see also FIG. 8B) such that when a water pressure is present in the conduits 601, 602 the water pressure will urge the pistons 605, 606 away from the cylinders 603, 604.

The device is furthermore provided with a vertical bar 607 such that when the vertical bar 607 is placed parallel to one of the bars 503 and a water pressure is activated the piston 605, 606 will be activated thereby urging the piston 605 or 606 against the vertical bar 503. At some point the vertical bar 503 will come into contact with the vertical bar 607 and the piston 605 or 606 will effectively squeeze the bar 503 such that a firm grip is provided for the cutting device 3.

Once the water pressure in the conduit 601, 602 is released, the pistons 605, 606 will be able to move backwards thereby releasing its grip on the vertical bar 503 such that the device may be removed from the vertical bar 503.

A further way of attaching the device to the wall is illustrated in FIG. 9. Here the support 1 is again provided as a water conduit. The water connection is created in the tubular connector 107 such that water from the firehose may be led into the support 1'.

In the other end of the support 1' is again provided expandable members 701, 702. The expandable members 701, 702 comprise a fixed central section 703 connected to the support 1. Inside the fixed section 703 are arranged 7 pistons 704, 704' such that as water pressure is introduced into the fixed section 703 the pistons 704, 704' will be urged sideways thereby coming into contact with the vertical bars 503.

The end of the pistons 704, 704' are provided with an oblique surface 705 such that the pistons 704, 704' will be wedged between the vertical bars 503 and the wall 502. In this manner the device is firmly fixed to the wall.

With reference to FIG. 10 a further way of attaching the device to the wall 502 by means of the vertical bars 503 is illustrated. The support 1 is connected to a shaped bar 801 comprising two sections 802, 803. The cutting device 3 as well as the support 1 is attached to the section 802. Some distance from the distal end 803' of the section 803 is provided a cut-out 804. The shape of the cut-out is as illustrated with reference to FIG. 10D such that the cut-out 804 has a small opening 805 and a wider bottom 806.

The opening is large enough to accommodate a vertical bar 503 such that as illustrated with reference to FIGS. 10B and 10C the section 803 may be fitted around the bar 503 and by tilting the bar as illustrated in FIG. 10C the bar 503 will become locked inside the cut-out 804 due to the geometric shape of the cut-out.

Returning to FIG. 10A when having placed the cut-out 804 over a bar 503 gravity caused by the length of the section 803 and the section where the cutting device is placed, i.e. the section 802, will cause the section 803 to obtain the position as illustrated in FIG. 10C. As the device 3 is activated, thereby pushing the drill into the wall 502 creating a reactive force in the opposite direction the shaped bar 801 will try to rotate around the bar 503.

Due to the provision of an extending distal end 803' the turning will be resisted as the distal end 803' engages the wall 502 such that it is possible to transfer the forces created by the drilling device 3 to the wall of the container 502.

A further manner in which to attach the device to a vertical bar 503 is illustrated with reference to FIG. 11. In this embodiment the device 3 and the support 1 is mounted on a first sliding bar 810. In this sliding bar an aperture 811 is provided such that the drill 305 can operate through the aperture 811.

The first slide bar 810 is connected to a second slide bar 812 by pivotable connectors 813. By simply displacing the slide bars 810, 812 relative to each other the distance will change due to the length of the connectors 813 such that in one position the slide bars 810, 812 will be firmly engaged with the vertical bar 503 such that the drilling action may commence at the desired height.

As again the drill 305 when pushed towards the wall 502 creates an outward force which would otherwise make the fastening device turn had it not been for the other slide bar 812. The slide bar 812 will resist the turning movement and thereby retain the device 3 in operative contact with the wall 502. When removing the device from the vertical bar 503 the sliding movement is just carried out in the opposite direction such that the distance between the slide bars 810, 812 is increased thereby releasing the slide bars from their engagement with the vertical bar 503.

In a further embodiment of how to attach the device to a wall by means of the vertical bars 503 the device 3 as illustrated with reference to FIGS. 12A and 12B is mounted on a wheel 820. In this embodiment the device 3 and the tubular connector 106 are connected by four supports to the wheel, but any suitable number of supports may be provided. The wheel is provided with engagement sections 821, 822 which engagement sections 821, 822 are provided with wedge shaped engagement ends 123.

By placing the wheel over the vertical bar 503 and rotating the wheel in any of the directions indicated by the arrows 830 the engagement sections 23 will engage the vertical bar 503 thereby locking the vertical bar 503 between the engagement sections 823 and the wheel 820. In this manner, simply by rotating the wheel a firm engagement will be attained between the wheels 820 and thereby the device 3 and the vertical bar 503 in such a manner that the cutting device will be able to cut through the wall.

When desiring to remove the device the wheel is turned in the opposite direction 830, 830' thereby releasing the engagement section's 823 engagement with the vertical bar 503.

In FIG. 13 is schematically illustrated the situation onboard a container ship where stacks of ISO containers 900 are arranged. In between the rows of ISO containers 900 is provided a division 901. The division will typically rise from the bottom of the hull 902 to a certain elevation, for example even with the railing of the ship. In this example 12 ISO containers are stacked one on top of the other, but in practice more or less containers may be stacked in this manner. In this situation a fire has been detected in one of the uppermost ISO containers 910 and a fire fighter 911 has erected the hoist 920 and fastened the hoist by means of the fastening bar (see FIGS. 15 and 16). In the illustrated example the fire fighter 911 is in the process of hoisting the fire fighting device 3 connected to a fire hose 110.

As the fire fighting device 3 travels up the hoist 920 pulling along the fire hose 110 the fire fighting device 3 will arrive at the intended destination 903 after which the fire fighting device is activated by increasing the water pressure thereby activating the fire fighting device to penetrate the door of the container and extinguish the fire inside the container 910.

Turning to FIG. 14 a similar scenario is illustrated, however, in this scenario the fire fighter 911 is elevated relative to the separation 901 by means of a lift 912. Instead of the lift it could be a scaffold, ladder or other means suitable for the task. In this manner it is possible to reach containers even further up or to avoid extending the hoist 920 to its full extent. In the illustrated example the fire fighting device 3 has been installed at the intended location 903, and consequently the fire fighting may commence.

Turning to FIGS. 15 and 16 two different means of retaining the fire fighting device 3 adjacent the upper end of the hoist device 920 are illustrated.

The hoist device 920 comprises a number of sections, in the embodiments illustrated in FIG. 13 three sections 920', 920", 920'". These extendable sections 920', 920", 920'" are concentrically arranged such that they may be extended as illustrated in FIGS. 13 and 14. In an uppermost end of the telescopic device is provided a pulley wheel 921. A wire is provided from the bottom of the hoist 920 around the pulley wheel and back initially to the bottom of the hoist. It is naturally clear that although a pully wheel is illustrated and suitable means for creating a low friction turning of the wire may be used, for example, blocks, low friction surface on a stainless steel bar or the like. In this manner it is possible to attach the fire fighting device 3 to the wire and after having positioned the hoist in its proper position as illustrated in FIGS. 13 and 14 hoist the fire fighting device 3 by pulling on the wire such that the fire fighting device will be elevated up to the upper end of the hoist 920.

Likewise the wire shall be understood as any suitable type of flexible elongated member. A stainless steel wire is preferred but also ropes made from various base materials, such as for example carbon fibres, glass fibres and the like is contemplated within the term wire.

In order to retain the fire fighting device 3 relative to the upper end of the hoist a releasable fastening mechanism 925 may be provided. The releasable fastening mechanism 925 as illustrated in FIG. 15 comprises a tab 926 which by means of a spring is urged outside the perimeter of the concentric section of the hoist 920 in such a manner that by having a further wire available at the bottom of the hoist the tab may be withdrawn in order to release its engagement with the fire fighting device.

As the fire fighting device is being hoisted towards the top of the hoist it will pass the position of the tab 926 such that the tab either will insert itself into an aperture provided in the support 1 of the fire fighting device or in the fire fighting device itself or below the support 1 in order to keep the fire fighting device fixed in the upper end of the hoist.

With reference to FIG. 16 a different mechanism for releasably fastening the fire fighting device 3 in an upper end of the hoist is illustrated. This mechanism comprises a pivotable member 927 which may be moved slightly in the longitudinal direction of the hoist 920 due to a pin 928 travelling in an elongated slut provided in the upper end of the hoist 920.

As the support or the fire fighting device passes the mechanism by lowering the hoist 920 a flange 930 will be manipulated in such a manner that a bar fixed between the flange 930 and the pivotable member 927 will flip the pivotable member either into engagement or out of engagement with the support or the fire fighting device itself.

By further lowering the hoist after the fire fighting has been concluded the flange 930 will again engage the fire fighting device whereby the pivotable member 927 will be pivoted out of the way allowing the fire fighting device to be lowered.

As already discussed above the hoist 920 is in an upper end provided with a fastening member 932. This fastening member is designed to be inserted between the vertical bars 503, in this connection see also FIGS. 6 and 7. The vertical bars are provided as part of the door locking mechanism and are a standard feature on ISO containers. A further standard feature of ISO containers are also the grooves 504. By arranging the fastening member 932 inside the groove 504 it is possible to manipulate the fastening member into engagement behind both bars 503 (see FIG. 7) such that the fastening member 932 is retained in the groove 504 by the two bars 503.

When the fire fighting device 3 is activated and engages the surface of the container 502 the reactive force will be countered by the fastening member's 532 engagement with the vertical bars 503 and in this manner the fire fighting device's drilling action will commence due to the urging of the drill member 305 into the wall 502 of the container.

In the illustrated embodiments the hoist comprises three sections, but in reality any suitable number of sections may be provided such that the hoist can elevate the fire fighting device to any desired height. As the fire fighting device 3 is only elevated into the desired elevation once the fastening member of the hoist has been correctly positioned at its elevated position it is possible to operate the invention with very high telescopic members. In practice, the telescopic members may be 15-20 meters such that after for example having engaged the fastening member 932 in a groove 504 in a ISO container at a height of 15 meters it is very simple to elevate the fire fighting device into the correct operational position as discussed above.

The invention has now been explained above with reference to a few simple embodiments, but in reality shall be interpreted in view of the appended claims.

The invention claimed is:

1. A fire fighting device with a fire fighting aggregate for penetrating a wall and injecting fire fighting fluid into a space behind the wall, said fire fighting aggregate comprising:

a fluid driven rotating motor having a rotor rotating around an axis of rotation defining an axial direction and a rotating cutting element attached to the rotor to be rotated thereby;

a fluid inlet for receiving fire fighting fluid from a source of fire fighting fluid;

a first conduit for feeding the fire fighting fluid from the fluid inlet to the rotor to drive the fluid driven rotating motor;

a support for non-penetrating attachment to the wall and the fire fighting aggregate being suspended by said support;

at least the rotating cutting element being movable relative to the support towards the wall;

wherein the fluid driven rotating motor comprises a stator attached to the support, the rotor being seated for rotation on said stator, the rotor comprising a driving part and a driven part, the driving part driving rotary the driven part and the driven part comprising a surface element, wherein the stator and the driven part between them define an annular chamber;

wherein said fire fighting aggregate further comprises a second conduit for feeding the fire fighting fluid from the fluid inlet to the annular chamber, such that water pressure building up in the annular chamber will act on the surface element of the driven part to expand said annular chamber and accordingly press the rotating cutting element towards the wall; and a power means for pressing the rotating cutting element towards the wall.

2. A fire fighting device according to claim 1, wherein the driven part is displaceable in an axial direction from a retracted position to an extended position together with the rotating cutting element and comprises a surface element constituting part of the power means, said surface element being subject to a pressure of the fire fighting fluid through the second conduit to press the rotating cutting element towards the wall.

3. A fire fighting device according to claim 2, wherein the stator and the driven part between them define an annular chamber receiving fire fighting fluid through the second conduit, said annular chamber being defined by a first external cylindrical surface of the stator, a first internal cylindrical surface of the driven part, an annular surface of the stator adjacent to the first external cylindrical surface, and said surface element constituted by an annular surface part of the driven part adjacent to the first internal cylindrical surface.

4. A fire fighting device according to claim 3, wherein the driven part comprises an end having a cylindrical end chamber extending from said annular surface part, said cylindrical end chamber accommodating an end part of the stator comprising at least a part of the first external cylindrical surface, when the driven part is in the retracted position, said end part of the stator being out of the cylindrical end chamber when the driven part is in the extended position, said first external cylindrical surface fitting slidably in said cylindrical end chamber, and wherein said cylindrical end chamber comprises a fluid outlet.

5. A fire fighting device according to claim 4, wherein the rotating cutting element is attached co-axially to the driven part and at least one passage is provided to receive fire fighting fluid from the fluid outlet for said fire fighting fluid to be ejected into a hole cut by the rotating cutting element.

6. A fire fighting device according to claim 3, wherein the stator comprises an annular protrusion with a second external cylindrical surface in sliding engagement with said first internal cylindrical surface, said annular protrusion comprising at one axial end said annular surface, said annular protrusion comprising at an opposite axial end a second annular surface, a third annular surface positioned opposite the second annular surface being connected to the first internal cylindrical surface, a second annular chamber thereby being provided between the second annular surface and the third annular surface, whereby either the area of the second annular surface part is bigger than the area of the third annular surface as seen in the axial direction, or the second annular chamber is vented to the surroundings.

7. A fire fighting device according claim 1, wherein the driving part comprises a hollow shaft member, a number of nozzles extending from the hollow shaft member to eject fire fighting fluid fed to the rotor, the nozzles thereby ejecting the fire fighting fluid in a direction with a circumferential component in a plane perpendicular to the axial direction.

8. A fire fighting device according to claim 1, wherein the stator comprises a circular cylindrical section which has a third external cylindrical surface and the driving part has a second internal cylindrical surface in sliding engagement with said third external cylindrical surface;

wherein the first conduit extends through the stator and out through at least one second aperture in the circular cylindrical section at the third external cylindrical surface at an axial position;

wherein the driving part at the second internal cylindrical surface comprises at least one third aperture for receiving fire fighting fluid from the first conduit;

wherein a circumferential recess defining an axial recess area is provided in one of the third external cylindrical surface and the second internal cylindrical surface; and wherein the second aperture and the third aperture are opening into said circumferential recess when the driving part is in an axial starting position relative to the stator.

9. A fire fighting device according to claim 8, wherein the driving part is displaceable in the axial direction relative to the stator from the axial starting position, which is a retracted position, to an extended position, whereby one of the second aperture and the third aperture is outside the axial recess area when the driving part is in the extended position.

10. A fire fighting device according to claim 1, wherein the support is provided with means for attachment to the wall, said means comprising one or more of: a magnet, a suction device, a hook, a claw, a pair of jaws, a clamp.

11. A fire fighting device according to claim 1, wherein the support comprises fluid conduit means, connected to one or more pistons provided in distal ends of the supports, which pistons are arranged such that the pistons are fluid operated and operable in a direction perpendicular to the axis around which the cutting device rotates, and where a land is provided towards which land the pistons may be urged.

12. A fire fighting device according to claim 11, where further a land is provided towards which land the pistons may be urged.

13. A fire fighting device according to claim 1, wherein the support is provided with means for attachment to the wall, said means including one or more wedge shaped elements, attached to a ring member, where said ring member is connected to the support, where the wedge shaped members extends away from the ring in a manner in use suitable to engage a vertical member, which vertical member thereby is fixed between the ring and the wedge shaped member.

14. A fire fighting device according to claim 1, wherein the support is provided with means for attachment to the wall, said means comprises two bars arranged perpendicular to each other where a first bar is attached to the support, and a second bar is attached to said first bar, such that the assembly point between the bars is adjacent an end of the first bar and centrally on the second bar.

15. A fire fighting device according to claim 1, wherein said fire fighting device further includes a hoist, said hoist comprising a telescopic section, where said telescopic section has a lower end and an upper end and two or more concentrically arranged extendible sections there between, where in the upper end a fastening bar is arranged perpendicular to the extendible sections, and a pully wheel, where a wire is provided from adjacent the lower end around the puly wheel and back to the lower end, where said wire comprises means for fastening the fire fighting device to an end of the wire.

16. A fire fighting device according to claim 15 wherein a winch is provided adjacent the lower end of the hoist, and where one end of the wire is wound around the winch.

17. A fire fighting device according to claim 15, where the two or more concentric sections of the hoist may be extended by applying a force to the lower ends of each concentric section, where said force is generated by one or more of the following: electrical motor means, hydraulic or hydro means, pneumatic means, mechanical means in the shape of a winch, releasable gas springs.

18. A fire fighting device according to claim 15 wherein adjacent the upper end of the hoist a releasable locking mechanism is provided, said locking mechanism suitable to interact and lock the fire fighting device in position adjacent the upper end of the hoist.

19. A fire fighting device according to claim 1, wherein the support is attached to a wall to be penetrated, a connection between a source of fire fighting fluid and the fluid inlet is provided, and wherein said connection is opened to provide a pressure of the fire fighting fluid at said fluid inlet between 2 to 50 bar.

20. A method of using a device according to claim 1 in order to quell a fire in an object at an elevated position, using a hoist according to claim 15, said object at an elevated position particularly being but not limited to a stack of iso containers, where it is desirable to apply the fire fighting device at a desired height, comprising the following steps:

a) the fire fighting device is attached to a free end of the wire;

b) the telescopic section is extended, such that the fastening bar arrives at the desired height where the fire fighting device is to be applied;

c) the fastening bar is brought into engagement adjacent the elevated position;

d) the fire fighting device is hoisted up to the elevated position and releasably locked into position; and e) fire fighting liquid is supplied to the fire fighting device which thereafter cuts into the object, and injects the fire fighting liquid into said object.

21. A method of using a device according to claim 1 in order to quell a fire in an object at an elevated position, using a hoist according to claim 15, said object at an elevated position particularly being but not limited to a stack of iso containers, where it is desirable to apply the fire fighting device at a desired height, comprising:

a) the telescopic section is extended, such that the fastening bar arrives at the desired height where the fire fighting device is to be applied;

b) the fastening bar is brought into engagement adjacent the elevated position;

c) the fire fighting device is attached to a free end of the wire;

d) the fire fighting device is hoisted up to the elevated position and releasably locked into position; and e) fire fighting liquid is supplied to the fire fighting device which thereafter cuts into the object, and injects the fire fighting liquid into said object.

22. A method of using a fire fighting device according to claim 1, wherein the support is attached to a wall to be penetrated, a connection between a source of fire fighting fluid and the fluid inlet is provided, and wherein opening said connection is opened to provide a pressure of the fire fighting fluid at said fluid inlet between 2 to 20 bar of fire fighting fluid at said fluid inlet.

23. A method of using a fire fighting device according to claim 1, wherein the support is attached to a wall to be penetrated, a connection between a source of fire fighting fluid and the fluid inlet is provided, and wherein opening said connection is opened to provide a pressure of the fire fighting fluid at said fluid inlet between 2 to 10 bar, of fire fighting fluid at said fluid inlet.

* * * * *